US006149955A

United States Patent [19]

Wilson

[11] Patent Number: 6,149,955

[45] Date of Patent: Nov. 21, 2000

[54] SNACK FOOD CONTAINER AND COIN BANK

[76] Inventor: Warren J. Wilson, 7 W. Shore Dr., Pennington, N.J. 08534-2118

[21] Appl. No.: 08/854,035

[22] Filed: May 9, 1997

[51] Int. Cl.[7] ..... A21D 10/02

[52] U.S. Cl. ..... 426/112; 426/394; 426/397; 206/0.8; 206/0.815; 215/228; 220/254

[58] Field of Search ..... 426/397, 112, 426/394; 206/0.8, 0.815; 215/228; 220/254; D99/34, 35; D1/127; D7/325, 326; D9/516, 528

[56] References Cited

U.S. PATENT DOCUMENTS

| | | | |
|---|---|---|---|
| D. 65,944 | 11/1924 | Potter | 206/457 |
| D. 155,467 | 10/1949 | Weill | D34/11 |
| D. 208,873 | 10/1967 | Skuplen | D44/9 |
| D. 209,599 | 12/1967 | Craighead | D34/11 |
| D. 334,455 | 3/1993 | Dworman et al. | D99/37 |
| D. 348,762 | 7/1994 | Burgos | D99/35 |
| D. 356,425 | 3/1995 | August | D99/37 |
| D. 358,016 | 5/1995 | August | D99/37 |
| 4,842,140 | 6/1989 | Mesnard | 206/457 |
| 5,056,681 | 10/1991 | Howes | 220/522 |
| 5,069,645 | 12/1991 | Dworman et al. | 446/8 |
| 5,450,979 | 9/1995 | Servick et al. | 220/739 |
| 5,503,274 | 4/1996 | Toffler et al. | 206/457 |

OTHER PUBLICATIONS

Coca Cola® Bottle Bank, Trademark Collectibles Depiction of Internet http://www.tm collectibles.com.

*Primary Examiner*—Nina Bhat
*Attorney, Agent, or Firm*—Lowe Hauptman Gopstein Gilman & Berner

[57] ABSTRACT

A snack food container comprises a blow molded extruded transparent polyvinyl chloride housing having solid wall and base segments, a token slot, and an opening through which a solid particulate snack food product is loaded into and removed from the housing. A releasable seal on an interior surface of the housing covers the token slot. The sealed cap, token slot seal and housing maintain the food product in a sealed state prior to the cap being removed and/or the seal being released. The housing is used as a token bank by inserting tokens through the released token slot after the food product has been removed from the housing and the seal has been released from the token slot. In one embodiment the token slot is a pressure sensitive adhesive strip adhesively attached to the housing, and in a second embodiment the slot is in the cap. The housing contains visible promotional material unrelated to the snack food.

26 Claims, 2 Drawing Sheets

SNACK FOOD CONTAINER AND COIN BANK

FIELD OF INVENTION

The present invention relates generally to solid snack food containers and, more particularly, to a solid snack food container including a sealed coin slot, and to a method of making and using same.

BACKGROUND ART

Containers for solid snack foods of the particulate type, e.g, shelled peanuts, popped popcorn, unshelled peanuts, pretzel nuggets, pretzel sticks, hard candy and jelly beans, have many different forms. The containers for many of these snack foods are plastic bags that are torn open and disposed of immediately after or prior to consumption of the snack food in the bag. Glass bottles and metal containers are also used, particularly for peanuts, hard candies and jelly beans. While the glass bottles and some of the metal containers can be used again for different purposes, most are not specifically designed to be reused for different purposes. While some snack food containers are attractive, lending themselves to reuse and double use, most have mundane configurations and appearance.

It is, accordingly, an object of the present invention to provide a new and improved solid particulate snack food container, particularly adapted to be used again for different purposes, and to a method of using and making same.

An additional object of the invention is to provide a new and improved solid snack food container, particularly adapted to be used again as a coin bank, wherein the container is attractive and includes promotional materials for goods and services unrelated to the snack food in the container.

An additional object of the invention is to provide a new and improved snack food container which can also be used as a coin bank, wherein the container includes a sealed token slot and a sealed cap, to assist in maintaining the freshness of perishable particulate snack foods and for security purposes.

SUMMARY OF THE INVENTION

In accordance with one aspect of the present invention, a container for a solid particulate snack food includes a hollow housing having solid wall and base segments, an opening, and a removable cap sealingly covering the opening. The container includes a token slot covered by a releasable seal. The cap, seals and housing maintain the solid snack food product in a sealed state prior to removal of the cap and release of the seal, to assist in keeping the solid snack food product in a relatively fresh state prior to the sealed cap being opened or the seal on the token slot being released.

The seals on the cap and token slot also perform a security function. If the seal is released before the snack food-containing housing is sold at retail, a retailer or prospective buyer is able to determine tampering with the snack food product.

The container is used as a token bank by inserting tokens through the released token slot after the seal has been released from the token slot and the solid snack food product has been removed from the housing. Preferably, the token slot seal is on an interior surface of the container to enhance the security function. The token slot seal also preferably includes a frangible pressure sensitive adhesive strip adhesively attached to the housing so the slot can be opened easily by pulling the adhesive strip from the cap or by inserting a suitable tool, e.g., a knife or scissors, through the strip and slot.

In one embodiment, the slot is in the cap and the housing is formed as a bottle having a tapered neck with an interior diameter sufficiently large to enable a substantially free gravity flow of the solid particulate snack food product into and out of the bottle. The diameter and taper are such that the bottle shape closely simulates a beer or soft drink bottle shape while enabling the bottle to be rapidly filled and easily emptied. Rapid filling increases production line throughput and ease of emptying as sought by consumers.

In one configuration wherein the solid snack food product has a size and shape corresponding with the size and shape of shelled peanuts or jelly beans, the bottle is about ten inches high and has an interior neck diameter that tapers from about 32 mm to about 36 mm. In another configuration, wherein the food product has a size and shape corresponding with the size and shape of popped popcorn, the bottle is either 20 inches or 24 inches high and the neck minimum interior diameter tapers from about 2¾ inches to about four inches.

In a second embodiment, the slot is in a portion of the housing different from the cap; preferably the housing has an exterior shape corresponding with the shape of athletic paraphernalia to assist in attractive marketing of the housing and the solid snack food product therein.

Preferably, in both embodiments, the housing is an extruded blow molded plastic (preferably polyvinyl chloride). Extruded blow molded plastic is a particularly advantageous construction technique because it results in a relatively inexpensive housing having the required rigidity and strength, with a minimum amount of excess plastic trim that must be removed.

A further aspect of the invention relates to a method of using a housing containing a solid particulate snack food product. The housing includes a removable sealed cap for an opening and a releasable sealed token slot. The method comprises unsealing and removing the cap so there is access to the solid snack food product through the opening. Then, the solid snack food product is removed through the opening. The sealed token slot is released after the cap is removed. After all the solid snack food product has been removed from the housing, tokens are inserted into the housing through the released token slot while the cap is in situ on the opening.

In normal use, only a portion of the solid snack food product is initially removed from the housing, and the cap is then reinserted on the housing. The coin slot seal remains intact when the cap is reinserted on the opening while a portion of the solid snack food product remains in the container. Thereafter, the cap is removed from the opening and then all the solid snack food product is removed from the housing, through the opening. After all the solid snack food product has been removed from the housing through the opening, the coin slot is released.

In one embodiment, the slot is formed in an extruded blow molded housing. The slot is sealed by (a) inserting a releasable pressure sensitive adhesive strip through the opening against the slot, and (b) pressing the adhesive strip against an interior surface of the housing abutting the slot. The housing is then filled with the solid snack food product.

In another embodiment, the slot is formed in the cap, and the slot is sealed by pressing a pressure sensitive adhesive strip against an interior surface of the cap abutting the slot. Preferably, the adhesive on the adhesive strip is released by pulling the strip from the cap, and at least a portion of the strip is pulled from the cap to release the strip from the slot.

The above and still further objects, features and advantages of the present invention will become apparent upon consideration of the following detailed descriptions of several specific embodiments thereof, especially when taken in conjunction with the accompanying drawings.

DESCRIPTION OF THE PREFERRED EMBODIMENT

Figure 1:
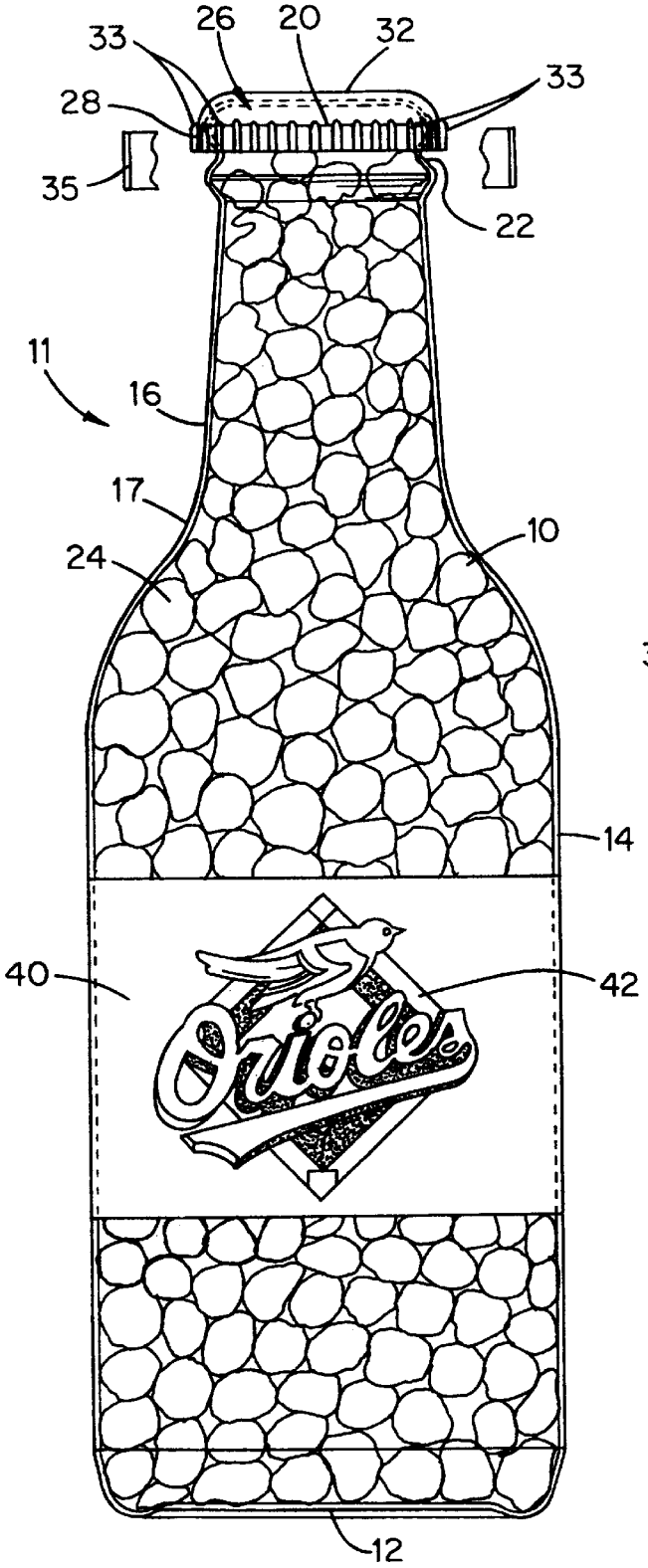
FIG. 1 is a side view of a plastic bottle containing popped popcorn, according to a first embodiment of the invention.
Figure 2:
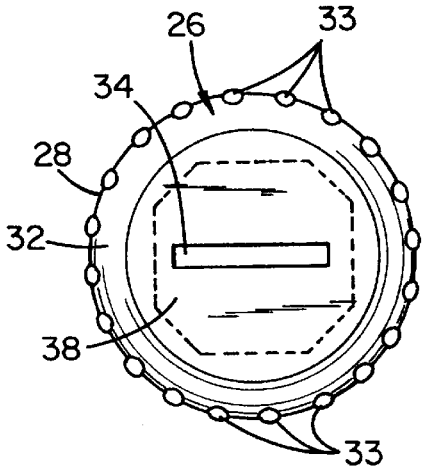
FIG. 2 is a top view of a cap on the bottle of FIG. 1.
Figure 3:
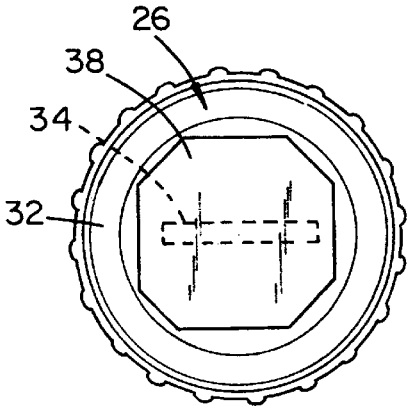
FIG. 3 is a bottom view of the cap illustrated in FIG. 2.

Reference is now made to FIGS. 1, 2 and 3 of the drawing wherein snack food container 11 of the present invention is illustrated as including blow molded extruded transparent or translucent polyvinyl chloride bottle 10, having a substantially planar base 12 and side wall 14, including neck 16 that tapers inwardly from shoulder 17 to cylindrical collar 22 just below opening 20 at the top of the bottle. Popped popcorn 24 is loaded by gravity through opening 20 and neck 16 into bottle 10. Because bottle 10 is made of inexpensive, readily available extruded blow molded transparent or translucent polyvinyl chloride, the bottle is relatively inexpensive with regard to materials and fabrication and the food product is readily visible to enhance marketing to consumers. By making bottle 10 by an extruded blow molding process, there is a very small amount of waste plastic material so plastic trimming operations are minimized.

Opening 20 is sealingly closed by cap 26, having cylindrical side wall 28 that is spanned by substantially planar top 32. Cap 26 is fixedly and sealingly mounted on bottle 10 by seal 35, formed as a plastic collar strip that circumferentially extends completely about cap side wall 28 and the upper portion of neck 16 so the seal is fastened to side wall 28 of cap 26 and neck 16 of bottle 10. To assist in manually breaking seal 35 by a twisting action of cap 26 relative to bottle 10, cap side wall 28 includes longitudinally extending gripping ridges 33.

Top 32 of cap 26 includes token slot 34, having sufficient length and width to receive coins as large as a United States silver dollar and folded bills. Pressure sensitive adhesive strip 38 is fixedly positioned on the interior face of top 34 to cover slot 34.

Cap 26 and bottle 10 are sealed by collar 35 and strip 38 in such a manner as to assist in preserving and maintaining fresh the perishable popped popcorn 24 in the bottle. In addition, by positioning strip 38 on the lower face of top 34 where the strip cannot be removed from cap 26 without breaking collar 35, security for the popped popcorn in bottle 10 is assured. Hence, tampering of the contents of bottle 10 is easily determined since such tampering requires breaking of collar 35 and/or adhesive strip 38.

In one preferred embodiment, bottle 10 has a height of about 24 inches and a neck 16 has a length of about eight inches. Neck 16 varies continuously in interior diameter from about 2⅞ inches at the top of the neck to about 4⅛ inches at shoulder 16. In a second embodiment, bottle 10 has a height of approximately 20 inches, a neck length of about 65 inches, with maximum and minimum interior neck diameters of approximately 2¾ inches and 2⅜ inches, respectively. The stated neck diameters enable the 24 inch and 20 inch bottles to provide a free flow by gravity of popped popcorn into and out of the bottles. It has been found, through experimentation, that the stated diameters are such that the 24 inch and 20 inch bottles can be filled with popped popcorn in less than five seconds, to satisfy fast throughput during the popcorn filling process. In another embodiment, wherein bottle 10 is nine inches high and is loaded with shelled peanuts or jelly beans, neck 16 has a length of about 2¾ inches, with maximum and minimum interior diameters respectively of about 36 mm and 32 mm to enhance throughput during filling and ease of emptying. In the nine inch embodiment, the cap and bottle include mating threads and the top of the neck has an interior diameter of about 32 mm.

The present invention is preferably used to promote solid particulate goods and services completely unrelated to the snack food product loaded into bottle 10. For example, the invention can be used to promote professional and collegiate ball teams and name brand beverages. To these ends, sheet 40, having ball team logo 42 printed on it, is adhesively attached to side wall 14. Ball team logos are particularly advantageous for the 10 inch high bottle, because such bottles are easily stocked and sold at ball games where the snack food contents thereof are consumed. A purchaser of bottle 10 including such a logo will, after attending a ball game at which the bottle and its contents were purchased, bring the bottle home, remove or cut strip 38 and begin using the bottle as a coin bank after the snack food has been emptied from the bottle. Thereby, the consumer retains a memento of the ball game at which the bottle and snack food were purchased. Each time the consumer inserts a coin into the bottle through slot 34 in cap 26, he or she is reminded of the ball game at which the bottle and snack food were bought.

Figure 6:
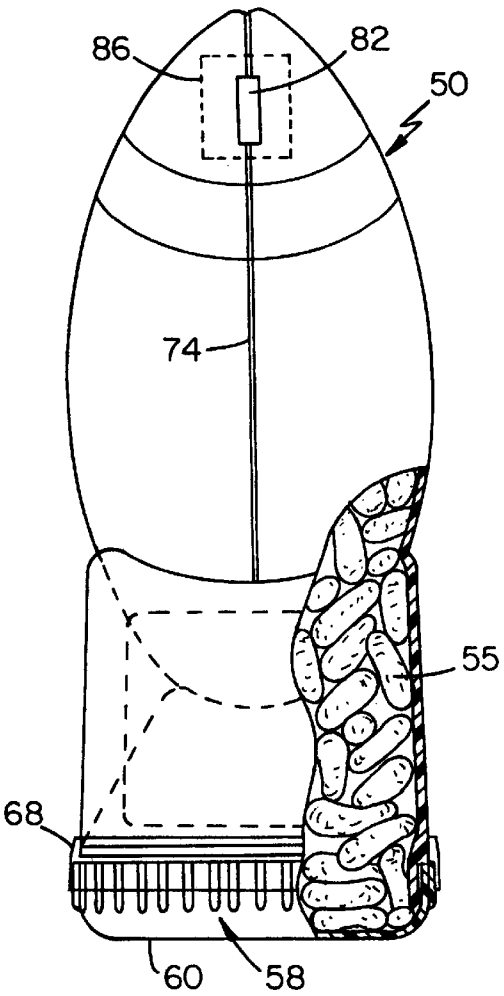
FIG. 6 is a back view of the embodiment illustrated in FIGS. 4 and 5.
Figure 5:
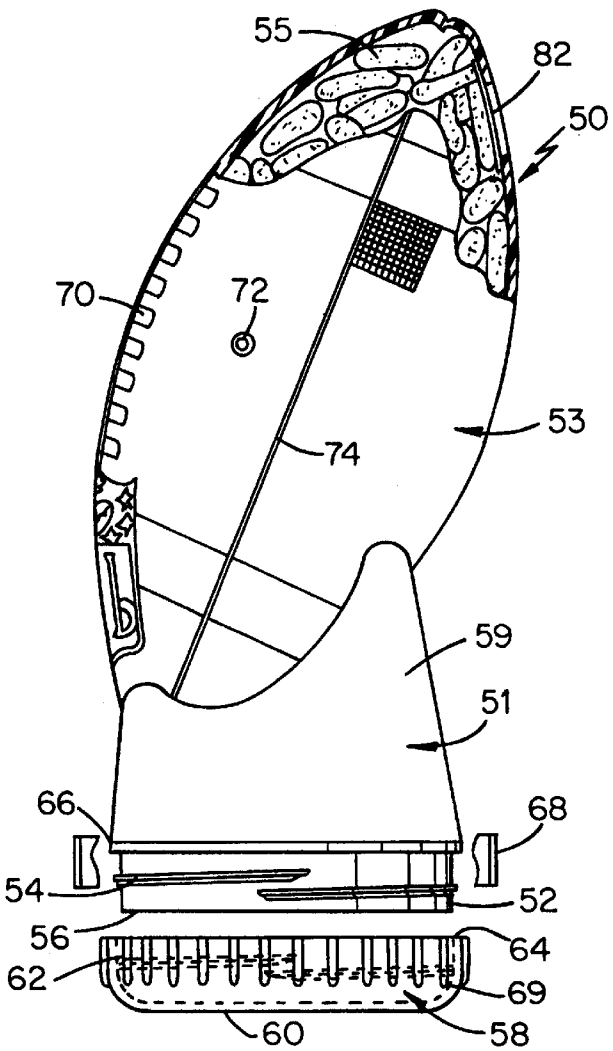
FIG. 5 is a side view of the embodiment illustrated in FIG. 4.
Figure 4:
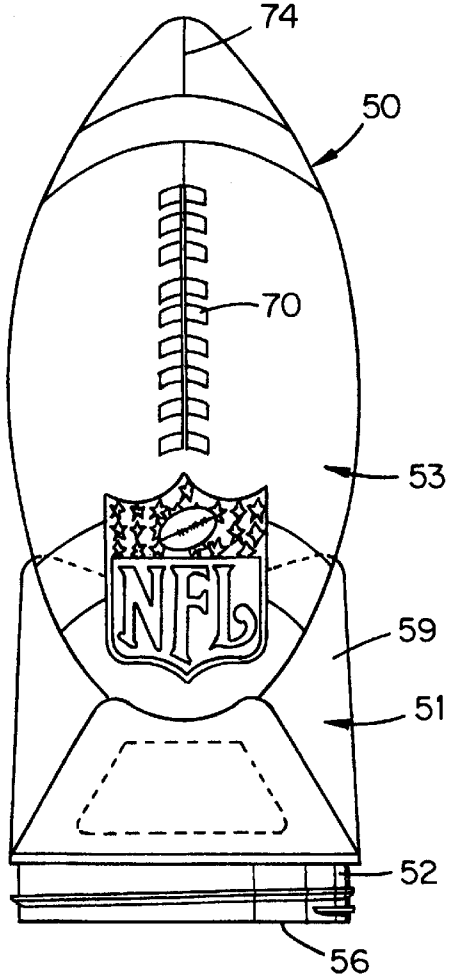
FIG. 4 is a front view of a further embodiment of the invention wherein a housing for the snack food container is shaped and sized in a manner similar to that of a football sitting on a kicking tee and a cap for the snack food is in the base of the tee and a token slot is on the body of the ball.

According to a further embodiment of the invention, illustrated in FIGS. 4–6, housing 50 forms a completely hollow one piece container filled with solid particulate snack food product 55, illustrated as shelled peanuts. Housing 50 is preferably formed as extruded blow molded polyvinyl chloride. Housing 50 is shaped and sized so it is configured substantially the same as a standard professional football sitting on a standard football kicking tee.

Housing 50 includes a lower portion 51 dyed, sized and shaped the same as a simulated kicking tee, and an upper generally ellipsoidal portion 53 dyed, sized and shaped the same as a U.S. football. Cylindrical lower side wall 52 carrying exterior screw threads 54 extends downwardly from lower kicking tee portion 51. Simulated tee lower portion 51 includes a simulated cradle 59, extending upwardly from shoulder 66. Football portion 53 appears to fit into simulated cradle 68. At the end of cylindrical side wall 52 remote from upper football portion 53 is circular opening 56, having a diameter sufficiently large to enable fingers and a thumb of an adult male to reach through the opening into the interior of housing 10, where a solid particulate snack food product, such as popped popcorn, shelled peanuts, unshelled peanuts, etc. are located. Typically, the inner diameter of opening 56 is approximately three inches. Cap 58, having a planar base 60 and threaded cylindrical side wall 62 that mates with threads 54 on side wall 52, is screwed onto threads 54 so top edge 64 of the cap abuts shoulder 66, just above side wall 52. Cap 58 is sealingly fastened to lower tee shaped portion 51 by plastic collar 68 adhesively secured to shoulder 66 and wall 62. To facilitate manual breaking of sealing collar 68 as well as opening and closing of cap 58, cap side wall 62 includes elongated, longitudinally extending ridges 69.

Simulated football 53 preferably includes aesthetic features, such as simulated raised laces 70, an engraved simulated air hole 72, and a dimpled pattern, simulating the leather "pigskin" of a football. Simulated football 53 also includes engraved lines 74, simulating seams of a football. League logo 76 is engraved on the exterior of simulated football 53, while a team logo printed on a pressure sensitive adhesive strip (not shown) can be secured to the side wall of simulated kicking tee 51 or football 53.

Coin slot 82 is positioned on the seam line 74 above simulated laces 70, and on the side of football 53 opposite from the laces, so that appearance of the ball is not materially adversely affected by the coin slot. Before snack food product 55 is loaded into housing 50, coin slot 82 is backed by pressure sensitive adhesive strip 86, inserted into the interior of housing 50 through opening 56 so the strip covers the coin slot.

After coin slot 82 has been sealed by pressure sensitive adhesive strip 86, the interior of housing 50 is filled with the particulated frangible solid snack food product flowing by gravity through opening 56. Then cap 58 is screwed onto housing 50. After the snack food has been loaded into housing 50 and opening 56 has been closed by cap 58, the cap is sealed to housing 50 by wrapping plastic sealing strip 68 around side wall 62 of the cap and the lower portion of side wall 52 of simulated kicking tee 51.

The structure of FIGS. 4–6 is frequently used by television viewers of ball games. After strip 68 and cap 58 have been removed, the consumer holds football segment 51 between his/her legs and then inserts digits of his/her hand into housing 50 through opening 56 to withdraw the solid particulate snack food in the housing through the opening. After the solid snack food in housing 50 has been consumed or completely removed from the housing, frangible strip 86 covering slot 82 is released, either by pulling the pressure sensitive adhesive of the strip away from the slot or by breaking the strip by inserting a knife or similar implement through the slot and the strip. Then cap 58 is screwed onto housing 50 and the assembly including housing 50 and cap 58 is placed on a flat bearing surface so base 60 of the cap rests against the flat surface to provide support for housing 50. Then coins are inserted into the housing through slot 82.

While there have been described and illustrated specific embodiments of the invention, it will be clear that variations in the details of the embodiments specifically illustrated and described may be made without departing from the true spirit and scope of the invention as defined in the appended claims.

What is claimed is:

1. In combination, a housing having solid wall and base segment and an opening, a removable cap sealingly covering the opening, a solid particulate snack food product in the housing, a token slot, a releasable seal covering the token slot, the removable seal cap, seal and housing maintaining the snack food product in a sealed state prior to the cap being removed and the seal being released, the housing being used as a token bank by inserting tokens through the released token slot after the food product has been removed from the housing and the seal has been released from the token slot.

2. The combination of claim 1 wherein the seal is on an interior surface of the housing.

3. The combination of claim 2 wherein the token slot seal includes a frangible pressure sensitive adhesive strip adhesively attached to the housing.

4. The combination of claim 2 further including a collar adhesively secured to adjacent portions of the housing and cap to form a seal between the cap and housing.

5. The combination of claim 1 wherein the slot is in the cap.

6. The combination of claim 5 wherein the housing is formed as a bottle having a neck with an interior diameter sufficiently large to enable a substantially free flow of the particulate snack food product into and out of the housing.

7. The combination of claim 6 wherein the food product has a size and shape corresponding with the size and shape of shelled peanuts or jelly beans, and the interior diameter is at least 32 mm.

8. The combination of claim 5 wherein the food product has a size and shape corresponding with the size and shape of popped popcorn, and the interior diameter is at least 50 mm.

9. The combination of claim 1 wherein the housing has optical properties enabling the food product to be seen by a viewer through at least a portion of one of the segments.

10. The combination of claim 1 wherein the slot is in a portion of the housing different from the cap.

11. The combination of claim 1 wherein the housing and cap are constructed and arranged so the cap is reinsertable on the housing.

12. The combination of claim 1 wherein the cap and the opening have diameters sufficiently large to enable an adult male to insert his hand through the opening into the housing to remove the food product from the housing with digits of the hand.

13. The combination of claim 1 wherein the housing is an extruded blow molded plastic structure.

14. The combination of claim 1 wherein the housing has an exterior shape corresponding with the shape of an article of athletic paraphernalia.

15. The combination of claim 1 wherein the housing has an exterior shape and size corresponding with the shape and size of an article of athletic paraphernalia.

16. The combination of claim 1 wherein the housing includes visible promotional material on an exterior segment thereof.

17. The combination of claim 1 further including a collar adhesively secured to adjacent portions of the housing and cap to form a seal between the cap and housing.

18. A method of using a container including a solid snack food product including (a) a housing, (b) a removable sealed cap on an opening of the housing, and (c) a releasable sealed token slot, the method comprising unsealing and removing the cap so there is access to the snack food product through the opening, then removing the snack food product through the opening, releasing the sealed token slot, and after all the snack food product has been removed from the housing inserting tokens into the housing through the released token slot while the cap is on the opening.

19. The method of claim 18 wherein only a portion of the food product is initially removed from the housing, and further including reinserting the cap on the housing after only a portion of the snack food product has been removed from the housing, the coin slot seal being intact while the cap is reinserted on the opening, thereafter removing the cap from the opening and then removing all of the snack food product from the housing through the opening, the coin slot being released after all the snack food product has been removed from the housing through the opening.

20. The method of claim 18 further including forming the housing by extrusion blow molding plastic.

21. The method of claim 18 further including forming the slot in the extruded blow molded plastic housing.

22. The method of claim 21 further including sealing the slot by (a) inserting a releasable pressure sensitive adhesive strip through the opening to cover the slot, and (b) pressing the adhesive strip against an interior surface of the housing abutting the slot; then filling the housing with the solid snack food product.

23. The method of claim 18 further including forming the slot in the housing.

24. The method of claim 23 further including sealing the slot by (a) inserting a releasable pressure sensitive adhesive strip through the opening against the slot, and (b) pressing the adhesive strip against an interior surface of the housing abutting the slot; then filling the housing with the solid food product.

25. The method of claim 18 further including forming the slot in the cap, and sealing the slot by pressing a pressure sensitive adhesive strip against an interior surface of the cap abutting the slot.

26. The method of claim 25 wherein the adhesive on the adhesive strip is releasable by pulling the strip from the cap, and further including pulling at least a portion of the strip from the cap to release the strip from the slot.

* * * * *